US006316036B1

(12) United States Patent
Hodson et al.

(10) Patent No.: US 6,316,036 B1
(45) Date of Patent: Nov. 13, 2001

(54) TEAR TAPE FOR PLASTIC PACKAGING

(75) Inventors: Jay D. Hodson, Greenville; Steven Andrew Willis, Appleton; Greg John Seeke, Neenah, all of WI (US)

(73) Assignee: Pechiney Emballage Flexible Europe (FR)

( * ) Notice: Subject to any disclaimer, the term of this patent is extended or adjusted under 35 U.S.C. 154(b) by 0 days.

(21) Appl. No.: 09/400,806

(22) Filed: Sep. 22, 1999

Related U.S. Application Data

(62) Division of application No. 09/352,897, filed on Jul. 13, 1999, which is a continuation of application No. 08/988,155, filed on Dec. 10, 1997, now abandoned.

(51) Int. Cl.[7] ..... B65D 30/02; B65D 33/00; B65D 77/32

(52) U.S. Cl. ..... 426/410; 426/123; 426/412; 426/415

(58) Field of Search ..... 426/123, 106, 426/410, 412, 415; 383/201, 205, 61, 203, 204, 908; 53/463, 450, 412

(56) References Cited

U.S. PATENT DOCUMENTS

| | | | | |
|---|---|---|---|---|
| 3,098,601 | * | 7/1963 | Anderson et al. | 383/205 |
| 3,291,377 | * | 12/1966 | Eggen | 383/205 |
| 3,458,377 | * | 7/1969 | Lucas | 383/205 |
| 3,520,469 | * | 7/1970 | Marx | 383/205 |
| 3,579,397 | * | 5/1971 | Schwarzkopf | 383/205 |
| 4,185,754 | * | 1/1980 | Julius | 221/63 |
| 4,337,284 | * | 6/1982 | Cooper et al. | 383/205 |
| 4,941,307 | * | 7/1990 | Wojcik | 53/412 |
| 5,211,443 | | 5/1993 | Kelly | 297/56 |
| 5,224,779 | * | 7/1993 | Thompson et al. | 383/5 |
| 5,366,295 | * | 11/1994 | Montessisa et al. | 383/201 |
| 5,406,756 | | 4/1995 | Bemis et al. | 52/16 |
| 5,486,327 | | 1/1996 | Bemis et al. | 264/211 |
| 5,553,943 | | 9/1996 | Cook et al. | 383/113 |
| 5,560,675 | | 10/1996 | Altheimer et al. | 297/33 |
| 5,560,677 | | 10/1996 | Cykana et al. | 297/218 |
| 5,565,159 | | 10/1996 | Cykana et al. | 264/177 |
| 5,605,245 | | 2/1997 | Bemis et al. | 220/324 |
| 5,620,428 | | 4/1997 | Hand | 604/317 |
| 5,650,178 | | 7/1997 | Bemis et al. | 425/130 |
| 6,228,458 | | 5/2001 | Pinchen et al. | 428/77 |

FOREIGN PATENT DOCUMENTS

| | | |
|---|---|---|
| 1217017 | 7/1990 | (CA) . |
| 2174899 | 4/1996 | (CA) . |
| 2183042 | 8/1996 | (CA) . |
| 2183720 | 8/1996 | (CA) . |
| 775498 | 5/1997 | (EP) . |
| 594267 | 6/1997 | (EP) . |
| 785066 | 7/1997 | (EP) . |

* cited by examiner

*Primary Examiner*—Nina Bhat
(74) *Attorney, Agent, or Firm*—McDermott, Will & Emery

(57) ABSTRACT

A heat resistant and heat sealable tear tape that can be used with a plastic package. The tear tape comprises a layer of an oriented film and a layer of a polymer sealant material. The polymer sealant has a melt temperature of below approximately 220° F. A plastic package can be made having a tear tape to provide a hermetically sealed package with a tear tape.

15 Claims, 4 Drawing Sheets

TEAR TAPE FOR PLASTIC PACKAGING

REFERENCE TO RELATED APPLICATIONS

This application is a divisional of U.S. patent application Ser. No. 09/352,897, filed on Jul. 13, 1999, which is a continuation of U.S. patent application Ser. No. 08/988,155 filed on Dec. 10, 1997 now abandoned.

BACKGROUND OF THE INVENTION

1. Field of the Invention

This invention relates generally to a tear tape for use with hermetically sealed plastic packages.

2. Background Art

Plastic packages for perishable food products require a hermetic seal in order to preserve the food products during shipment and storage. It is also desirable to provide a tear tape or tear strip on such packages to allow a person to open the package easily. Using a tear tape to open a package also provides a clean tear along an edge of the package. This is especially useful so that a package can be easily reclosed with a zipper. Such a tear tape must not affect the initial hermetic seal of the package.

A drawback with current tear tapes is that they do not seal well with plastic packaging and therefore do not provide a good hermetic seal at the sides of the package which are likely heat sealed together. A conventional tear tape often is applied with pressure sensitive adhesive. While pressure sensitive adhesive adheres well to packaging, it does not provide a true hermetic seal, which is achieved with a heat sealable tear tape.

One known tear tape uses linear low density polyethylene (LLDPE) as a heat sealable adhesive. The melt temperature of LLDPE, which is the temperature required to activate the heat seal between the tear tape and the package film, is approximately between 220°–230° F. Applying enough heat to reach the melt temperature of LLDPE can cause distortion of the package film. Additionally, because it takes time to heat the LLDPE sealant layer of the tear tape to these temperatures, the speed of processing products containing such a tear tape is limited.

Furthermore, current tear tapes are unreliable when used on packages that are exposed to high humidity and refrigerated conditions. Such tear tapes can become brittle and break when pulled to open the package. Additionally, currently known tear tapes have heat resistance limitations and demonstrate heat shrinkage if the packaging machine or manufacturing line which affixes the tear tape onto a package is shut down for any length of time.

SUMMARY OF THE INVENTION

The tear tapes of the present invention have a polymer sealant layer which has a melt temperature of below approximately 220° F. Accordingly, the speed at which the tear tapes can be applied and sealed to packaging films can be increased because it takes less time to heat the polymer sealant of the tear tapes to the melt temperature. Additionally, by using a polymer sealant having a melt temperature of below approximately 220° F., distortion of packaging films is greatly reduced because the packaging films are subjected to lower temperatures when tear tapes are applied and sealed to the packaging films.

It is one of the principal objectives of the present invention to provide tear tapes that can be used on hermetically sealed packaging while not affecting the hermetic seal of the package.

It is another object of the invention to provide tear tapes that seal to plastic packaging at temperatures below approximately 220° F. and will not cause distortion of the package film.

It is still another object of the invention to provide tear tapes that can be applied to a package at high speeds.

It is another object of the invention to provide tear tape structures which have high heat resistance.

It is another object of the present invention to provide heat resistant tear tape structures that are based on oriented polyethylene terephthalate (PET), oriented polypropylene (OPP) or biaxially oriented nylon (BON).

It is still another object of the invention to provide heat sealable tear tape structures which do not demonstrate tape breakdown or shrinkage if the manufacturing line is shut down for long periods of time.

It is a further object of the invention to provide heat resistant, heat sealable tear tapes that have a high resistance to moisture.

It is still a further object of the invention to provide reclosable packaging having initial hermetic seals and heat resistant, heat sealable tear tapes.

It is another object of the invention to provide tear tapes that maintain strength when exposed to refrigerated conditions.

FIGS. *6a–6d* are flow charts depicting the manufacturing process.

DETAILED DESCRIPTION OF THE DRAWINGS

Figure 1:
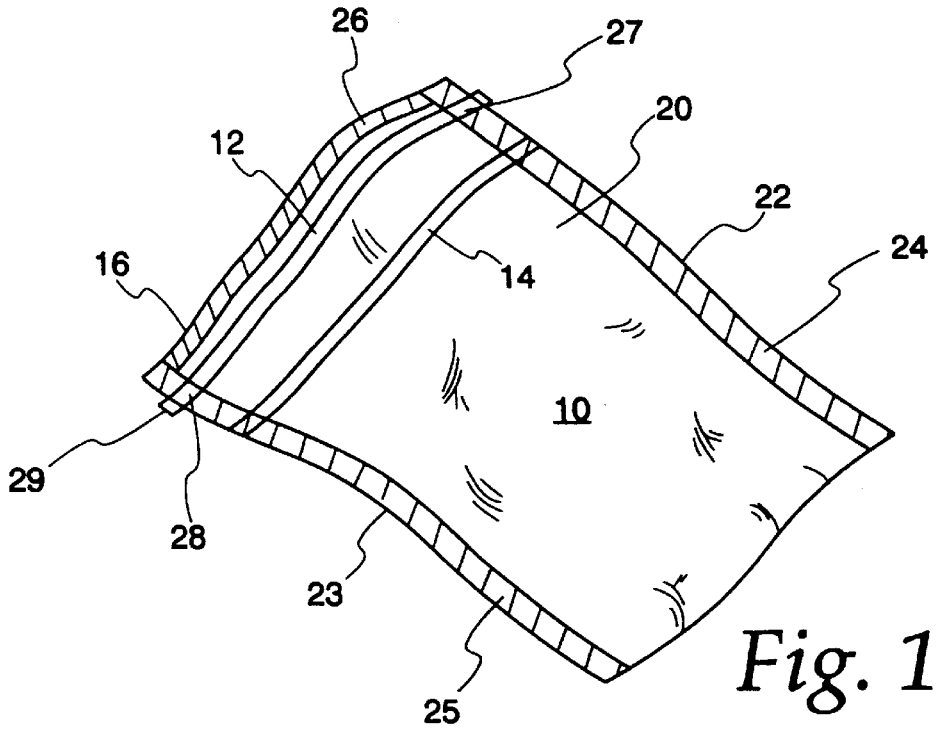
FIG. 1 is a side view of a package having a tear tape of the present invention.

FIG. 1 shows a plastic package 10 containing a heat resistant, heat sealable tear strip or tear tape 12 according to the present invention. The plastic package 10 shown is especially useful for storing perishable commercial food products such as cheese or meat products.

The package 10 can be made of PET, polyvinylidenechloride (PVdC), polyethylene (PE) or other high barrier composite structures. A conventional plastic packaging reclosable zipper 14 is provided on the package near an end 16 of the package 10. The zipper 14 is attached by conventional methods such as by heat.

The tear tape 12 is preferably located between the reclosable zipper 14 and the end 16 of the package 10, as shown in FIG. 1. As shown, the tear tape 12 is attached to an inner layer of a wall 20 of the package 10. The package 10 is hermetically sealed along its sides 22 and 23 and along end 16 providing hermetic seals 24, 25 and 26, respectively. As shown in FIG. 1, an end 29 of the tear tape 12 extends across side 23 and hermetic seal 25 of the package 10. A person can open the package 10 by gripping the end 29 of the tear tape 12 and pulling the tear tape 12 across the length of the package, parallel to edge 16.

A typical preferred structure of a package 10 that is used to package chunk cheese is as follows:

| | |
|---|---|
| First Layer | PET (48 Ga) |
| Second Layer | Ink |
| Third Layer | Low density polyethylene (LDPE) |
| Fourth Layer | PVdC |
| Fifth Layer | OPP |
| Sixth Layer | ethylene vinyl acetate (EVA) |

A typical preferred structure of a package that is used to package shredded cheese is:

| | |
|---|---|
| First Layer | PET |
| Second Layer | PVdC |
| Third Layer | Ink/Print layer |
| Fourth Layer | LDPE |
| Fifth Layer | EVA |
| or: | |
| First Layer | PET |
| Second Layer | LDPE |
| Third Layer | EVA\Tie\EVOH\Tie\Single Site PE |

Note that the inner or sealant layer of a typical package is the EVA layer. The layer of EVA therefore is usually the layer that comes into contact with the tear tape 12. The tear tape 12 is affixed to an inner layer of the package 10 by conventional means, such as by heat, before the package 10 is filled and sealed.

The package 10 is formed by conventional methods as well. Typically the tear tape 12 and zipper 16 are affixed to a flat sheet of plastic packaging material which will form the wall 20. After the tear tape 12 and zipper 16 are affixed, a food product such as cheese is placed on the sheet of material and the sheet is then folded over the product and hermetically sealed along its sides 22 and 23 and edge 16 to form the package 10 as shown in FIG. 1.

The following examples are intended to illustrate preferred embodiments of the invention, but are not intended to limit the scope of the invention.

FIRST EXAMPLE

Figure 2:
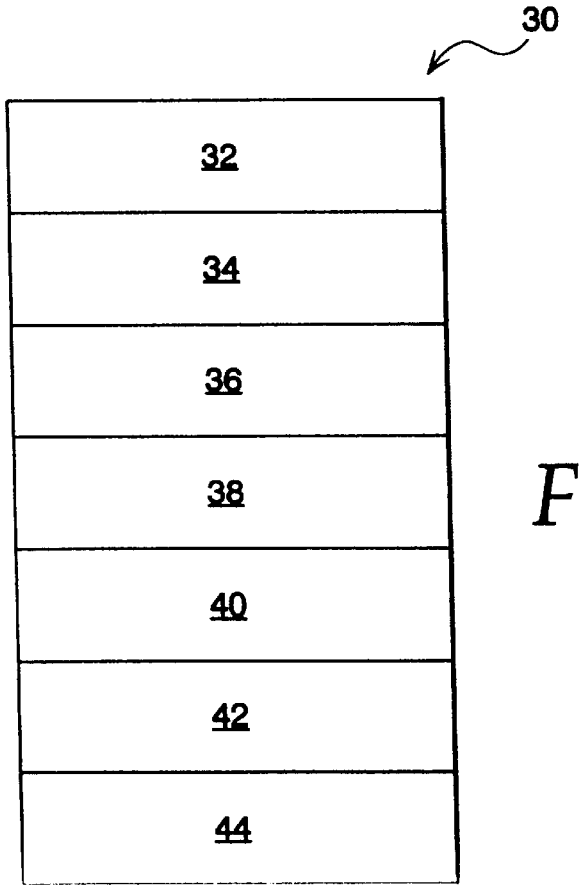
FIG. 2 is a cross-sectional side view of one embodiment of a tear tape according to the present invention.

A first example of a heat resistant and heat sealable tear tape 30 is shown in FIG. 2. The tear tape 30 has a first polymer sealant layer 32. A first tie layer 34 is attached to the first polymer sealant layer 32. A first layer of an oriented film 36 is attached to the first tie layer 34. An adhesive 38 is attached to the first layer of oriented film 36. A second layer of an oriented film 40 is attached to the adhesive 38. A second tie layer 42 is attached to the second layer of oriented film 40. Finally, a second polymer sealant layer 44 is attached to the second tie layer 42.

The polymer sealant layers 32 and 44 are selected from the group consisting of coextruded ethylene methyl acrylate (EMA), coextruded ethylene vinyl acetate (EVA), ionomer, ethylene acrylic acid (EAA) and a single site polyethylene. All of these polymer sealants have melt temperatures of below approximately 220° F.

Applicants have found that by using a polymer sealant having a melt temperature of below approximately 220° F. the speed at which the tear tape can be applied and sealed to the packaging can be increased because it takes less time to heat the sealant to its melt temperature. Additionally, it was found that by using sealants with melt temperatures below approximately 220° F. that distortion of packaging films is greatly reduced because the packaging films are subjected to lower temperatures when tear tapes are applied and sealed to the packaging films.

The coextruded EMA has a melt temperature of approximately between 180°–190° F. The coextruded EVA has a vinyl acetate content of greater than 10% such that the coextruded EVA has a melt temperature of approximately between 180°–190° F. The ionomer has a melt temperature of approximately 190°–200° F. The EAA has a melt temperature of approximately 200° F. The single site PE has a melt temperature of approximately 190° F. Preferably the sealant layers are coextruded EMA or coextruded EVA and are at least about 0.5 mils thick.

The adhesive tie layers 34 and 42 can be selected from the group of ethylene N-butyl acrylate (ENBA) or anhydride-modified adhesives.

The layers of oriented film 36 and 40 are approximately at least 0.32 mils thick. The layers of an oriented film 36 and 40 can be PET, OPP or biaxially-oriented nylon (BON). Preferably, the layers of oriented film 36 and 40 are PET and approximately 0.75 mils thick.

The adhesive 38 is selected from the group consisting of polyester and polyurethane. Preferably, the adhesive is polyester.

The preferred structure of the tear tape 30 is symmetrical from top to bottom. This way the orientation of the tear tape 30 when it is applied and sealed to a package does not affect the seal of the tear tape 30 to the package.

It is particularly effective to use the same or complementary materials as the outer layer 32 or 44 of the tear tape and the inner layer of the package because they are heat sealed together. Using the same or complementary materials provides a strong hermetic seal in the areas 27 and 28 along sides 22 and 23 where the tear tape 12 is present (FIG. 1).

The present multilayer tear tape 12 provides an excellent combination of high tensile strength for opening the package 10 and a strong hermetic seal. Generally, the core layer of the tear tape, which is usually PET, is the layer of the tear tape that provides strength and heat resistance to the tear tape 12.

SECOND EXAMPLE

Figure 3:
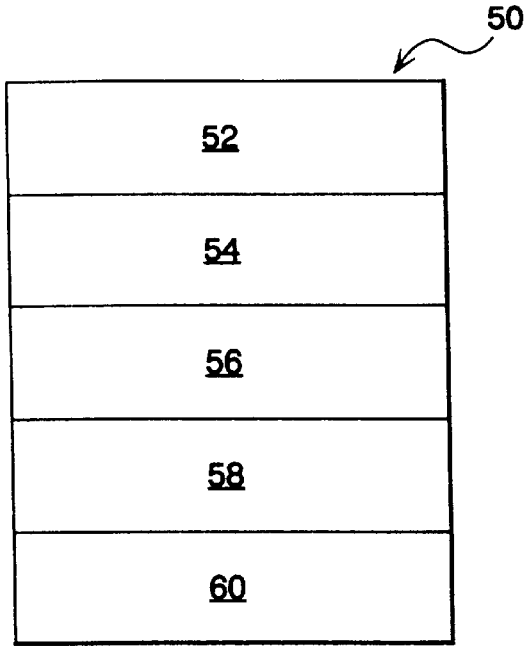
FIG. 3 is a cross-sectional side view of a second embodiment of a tear tape according to the present invention.

A second example of a tear tape 50 of the present invention is shown in FIG. 3. The heat resistant and heat sealable tear tape 50 has a first layer of a polymer sealant 52. A second layer 54 is a tie layer and is attached to the first layer 52. A third layer 56, which is an oriented film is attached to the second layer 56. A fourth layer 58, which is another tie layer is attached to the third layer 56. A fifth layer 60, a polymer sealant, is attached to the fourth layer 58.

The layers of polymer sealant 52 and 60 are selected from the group consisting of EMA, EVA, ionomer, EAA and single site PE, all of which are described above. The layers of polymer sealant 52 and 60 preferably are coextruded EMA.

The tie layers 54 and 58 are preferably ENBA.

The layer of oriented film 56 preferably is a layer of PET, OPP or BON and is at least approximately 0.48 mils thick. The layer of oriented film 56 is preferably approximately 1 mil thick.

THIRD EXAMPLE

Figure 4:
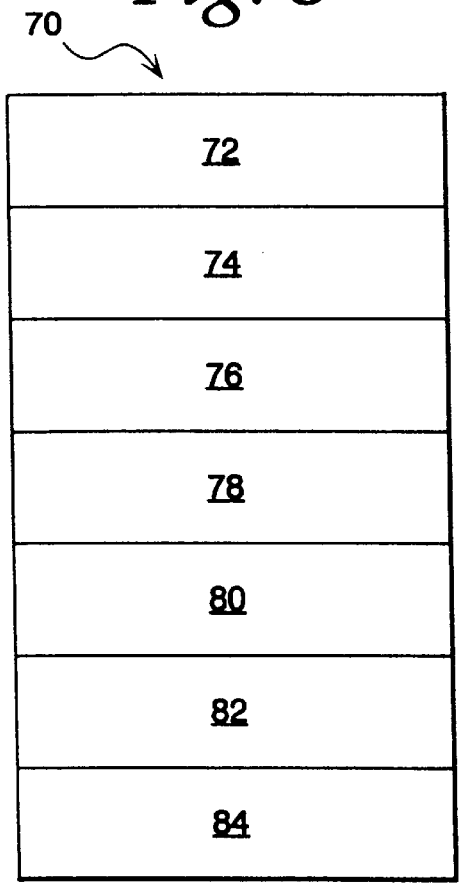
FIG. 4 is a cross-sectional side view of a third embodiment of a tear tape according to the present invention.

A third example of a heat resistant and heat sealable tear tape 70 is shown in FIG. 4. The tear tape shown in FIG. 4 has a first polymer sealant layer 72. A first primer layer 74 is attached to the first polymer sealant layer 72. A first layer of oriented film 76 is attached to the first primer layer 72. An adhesive 78 is attached to the first layer of oriented film 76. A second layer of an oriented film 80 is attached to the adhesive 78. A second primer layer 82 is attached to the second layer of oriented film 80. A second polymer sealant layer 84 adjacent the second primer layer 82.

The polymer sealant layers 72 and 84 are selected from the group consisting of EMA, EVA, ionomer, EAA and single site PE, all of which are described above. The polymer sealant layers 72 and 84 are preferably coextruded EMA or coextruded EVA. The polymer sealant layers 72 and 84 are also preferably at least 0.5 mil thick.

The layers of primer 74 and 82 can be selected from the group of conventional extrusion primers such as polyethylene imine (PEI), cross linked polyethylene imine, malamine and adhesive curing primer.

The layers of oriented film 76 and 80 preferably are layers of PET, OPP or BON and are preferably approximately at least 0.32 mils thick. The layers of oriented film 76 and 80 are preferably approximately 0.75 mils thick.

The adhesive 78 is selected from the group consisting of polyester and polyurethane. Preferably, the adhesive 78 is polyester.

FOURTH EXAMPLE

Figure 5:
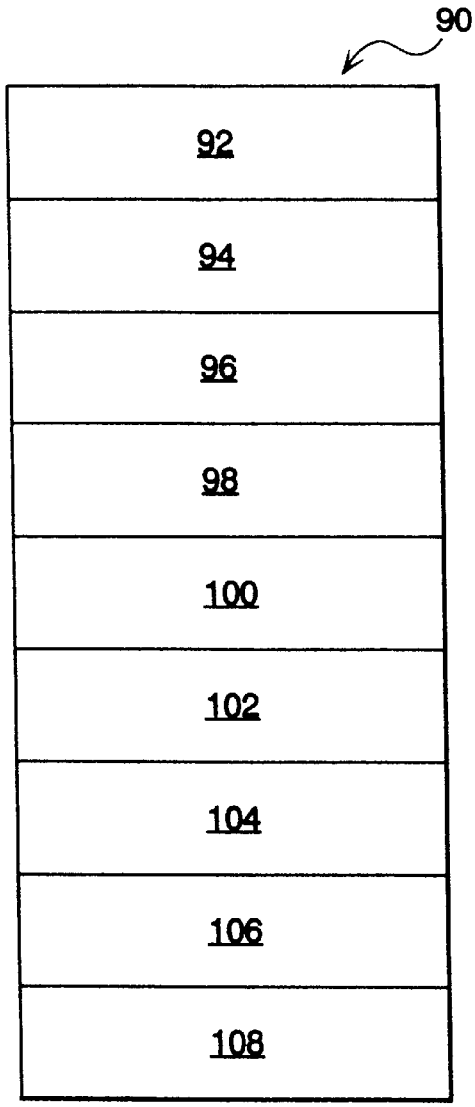
FIG. 5 is a cross-sectional side view of a fourth embodiment of a tear tape according to the present invention.
Figure 6A:
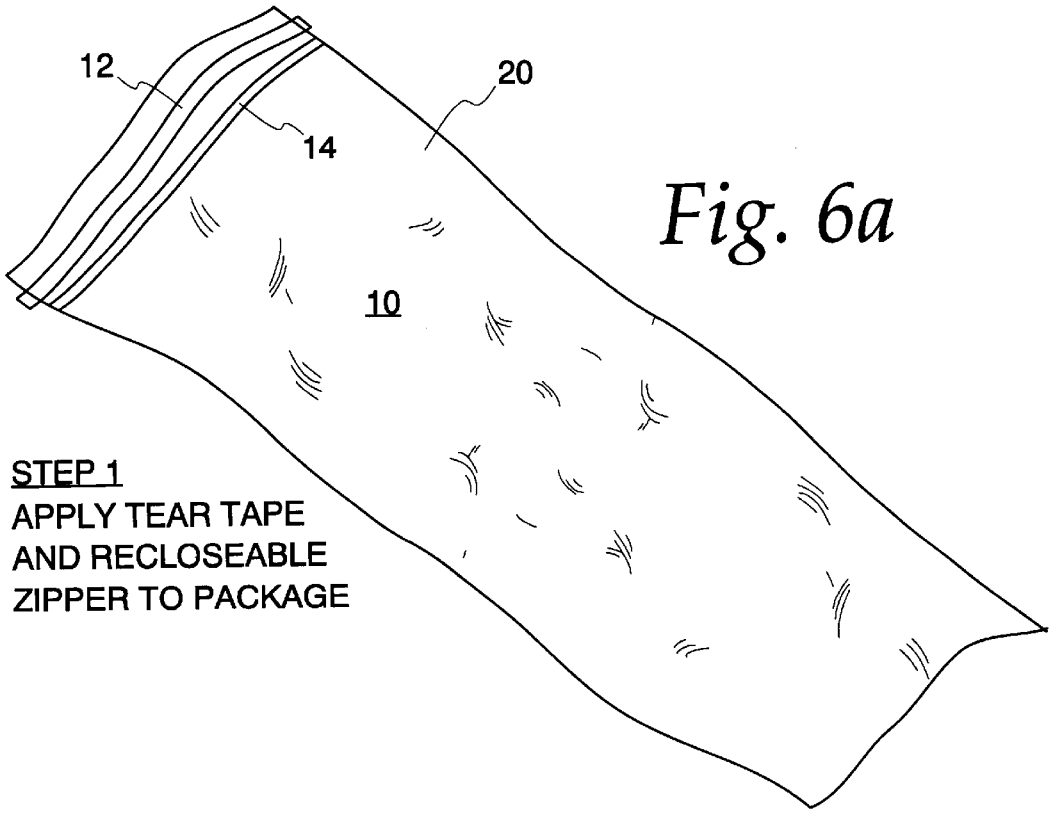
Figure 6B:
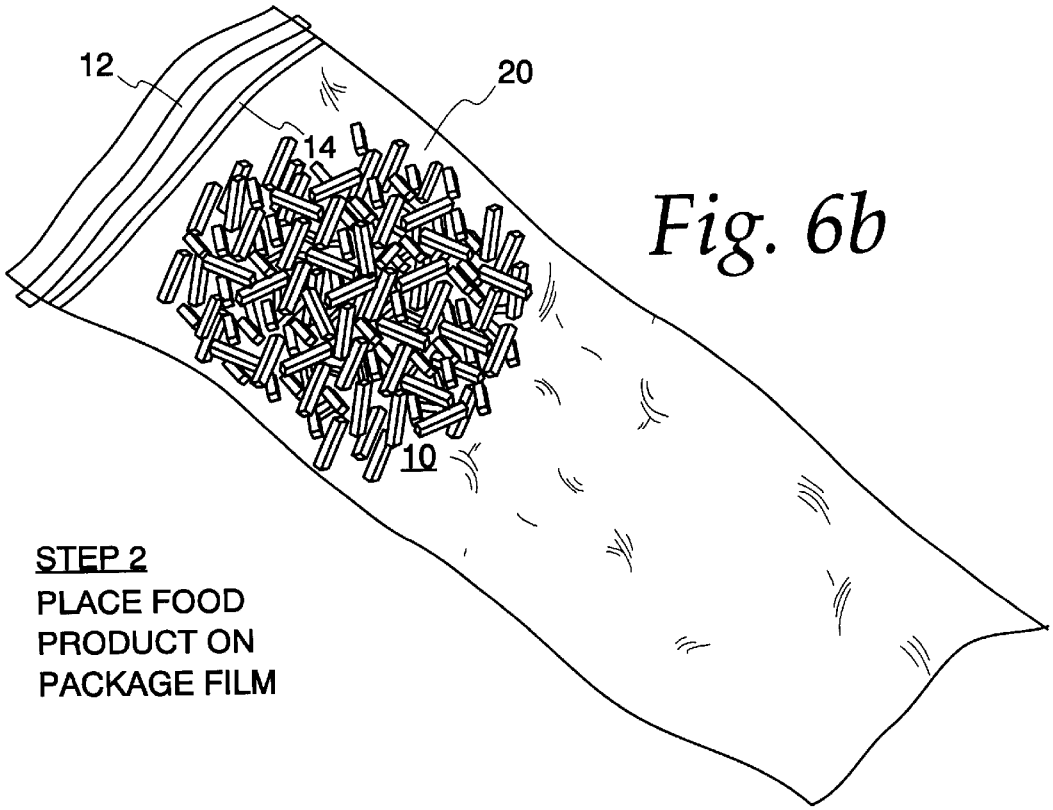
Figure 6C:
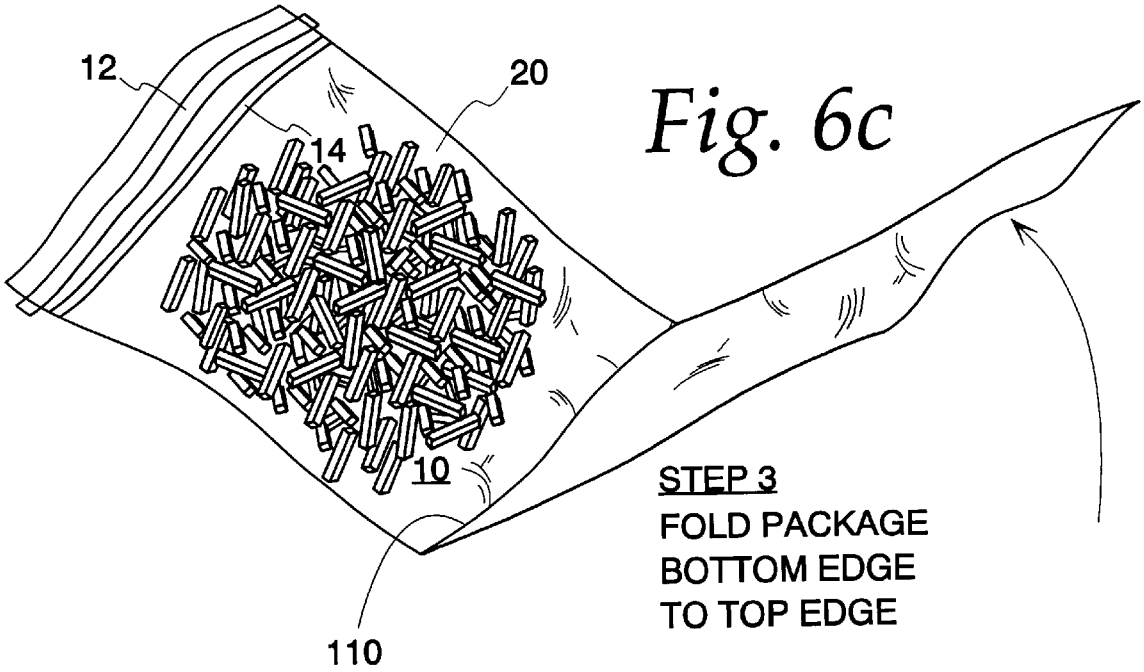
Figure 6D:
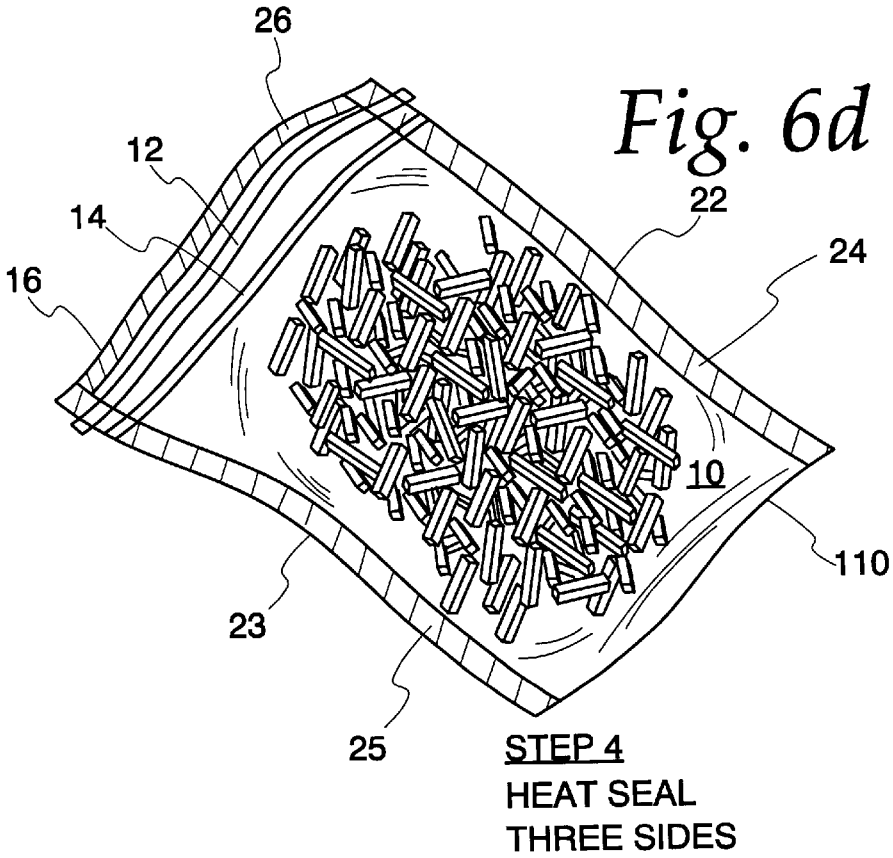

A fourth example of a heat resistant and heat sealable tear tape 90 is shown in FIG. 5. The tear tape 90 includes a first polymer sealant layer 92, a first layer of polyethylene 94, a first layer of primer 96 adjacent the first layer of polyethylene 94, a first layer of oriented film 98 adjacent the first layer of primer 96, an adhesive 100 attached to the first layer of oriented film 98, a second layer of oriented film 102 adjacent the adhesive 100, a second layer of primer 104 adjacent the second layer of PET 102, a second layer of polyethylene 106 adjacent the second layer of primer 104 and, a second polymer sealant layer 108 adjacent the second layer of polyethylene 106.

The polymer sealant layers 92 and 108 are selected from the group consisting of EMA, EVA, ionomer, EAA and single site PE, all of which are described above. The polymer sealant layers 92 and 108 preferably are coextruded EMA or coextruded EVA. The polymer sealant layers 92 and 108 are preferably approximately at least 0.25 mil thick and most preferably are approximately 0.5 mils thick.

The layers of PE 94 and 106 are preferably approximately 0.25 mils thick. The layers of primer 96 and 104 can be selected from the group of conventional extrusion primers such as polyethylene imine (PEI), cross lined polyethylene imine, malamine and adhesive curing primer.

The layers of oriented film 98 and 102 are preferably layers of PET, OPP or BON and are approximately at least 0.32 mils thick and preferably approximately 0.75 mils thick.

The adhesive 100 is selected from the group consisting of polyester and polyurethane. The adhesive 100 is preferably polyester.

Multilayer films of the instant invention can be formed by conventional processes for making films and multilayer films including laminations, extrusions, coextrusions, extrusion coatings and the like.

From the foregoing description, it will be apparent that the tear tape of the present invention has a number of advantages, some of which have been described above and others of which are inherent in the tear tape of the present invention. Also, it will be understood that modifications can be made to the tear tape of the present invention without departing from the teachings of the invention. Accordingly the scope of the invention is only to be limited as necessitated by the accompanying claims.

What is claimed is:

1. A method of forming a package comprising the steps of:

providing a sheet of plastic packaging material having two sides and a top edge and a bottom edge;

attaching a heat sealable tear tape to said plastic packaging material;

placing a food product on said plastic packaging material;

folding said plastic packaging material over said food product such that said top edge and said bottom edge are aligned;

sealing said folded plastic packaging material along said two sides and along said aligned top and bottom edges to form a package; and providing an end on the tear tape which extends beyond the sealed sides of the package for pulling the tear tape to open the package, wherein the heat sealable tear tape forms a hermetic seal on the packaging.

2. The method of claim 1, wherein said folded plastic packaging material is heat sealed along said two sides and along said aligned top and bottom edges.

3. The method of claim 1, wherein said folded plastic packaging material comprises multiple film layers.

4. The method of claim 1, further comprising the step of attaching a reclosable zipper to said plastic packaging material prior to placing said food product on said plastic packaging material.

5. A method of forming a package comprising the steps of:

providing a sheet of plastic packaging material having two sides and a top edge and a bottom edge;

attaching a heat sealable tear tape to said plastic packaging material;

attaching a reclosable zipper to said plastic packaging material;

placing a food product on said plastic packaging material;

folding said plastic packaging material over said food product such that said top edge and bottom edge are aligned;

sealing said folded plastic packaging material along said two sides and along said aligned top and bottom edges to form a package; and providing an end of the tear tape which extends beyond the sealed sides of the package for pulling the tear tape to open the package, wherein the heat sealable tear tape forms a hermetic seal on the packaging.

6. The method of claim 5, wherein said heat sealable tear tape comprises:

a layer of an oriented film having a first and a second side; and a layer of a polymer sealant material located on one side of the oriented film;

said polymer sealant material having a melt temperature of below approximately 220° F.

7. The method of claim 6, wherein said polymer sealant material is selected from the group consisting of ethylene methyl acrylate, ethylene vinyl acetate, ionomer, ethylene acrylic acid and single site polyethylene.

8. The method of claim 7, wherein said polymer sealant is coextruded ethylene methyl acrylate.

9. The method of claim 7, wherein said polymer sealant is coextruded ethylene vinyl acetate.

10. A hermetically sealed plastic package made by a process comprising the steps of:

providing a sheet of plastic packaging material having two sides and a top edge and a bottom edge;

attaching a heat sealable tear tape to said plastic packaging material;

placing a food product on said plastic packaging material;

folding said plastic packaging material over said food product such that said top edge and said bottom edge are aligned;

sealing said folded plastic packaging material along said two sides and along said aligned top and bottom edges to form a package; and providing an end of the tear tape which extends beyond the sealed sides of the package for pulling the tear tape to open the package.

11. A hermetically sealed plastic package made by the process comprising the steps of:

providing a sheet of plastic packaging material having two sides and a top edge and a bottom edge;

attaching a heat sealable tear tape to said plastic packaging material;

attaching a reclosable zipper to said plastic packaging material;

placing a food product on said plastic packaging material;

folding said plastic packaging material over said food product such that said top edge and said bottom edge are aligned;

sealing said folded plastic packaging material along said aligned top and bottom edges to form a package; and providing an end of the tear tape which extends beyond the sealed sides of the package for pulling the tear tape to open the package, wherein the heat sealable tear tape forms a hermetic seal on the packaging.

12. The hermetically sealed plastic package of claim 11, wherein said heat sealable tear tape comprises:

a layer of an oriented film having a first and a second side; and a layer of a polymer sealant material located on one side of the oriented film;

said polymer sealant material having a melt temperature of below approximately 220° F.

13. The hermetically sealed plastic package of claim 12, wherein said polymer sealant material is selected from the group consisting of ethylene methyl acrylate, ethylene vinyl acetate, ionomer, ethylene acrylic acid and single site polyethylene.

14. The hermetically sealed plastic package of claim 13, wherein said polymer sealant is coextruded ethylene methyl acrylate.

15. The hermetically sealed plastic package of claim 13, wherein said polymer sealant is coextruded ethylene vinyl acetate.

* * * * *